US010115505B2

(12) United States Patent
Murakami et al.

(10) Patent No.: US 10,115,505 B2
(45) Date of Patent: Oct. 30, 2018

(54) CHIP RESISTOR

(71) Applicant: E I DU PONT DE NEMOURS AND COMPANY, Wilmington, DE (US)

(72) Inventors: Mamoru Murakami, Yokohama (JP); Yusuke Tachibana, Kanagawa (JP)

(73) Assignee: E I DU PONT DE NEMOURS AND COMPANY, Wilmington, DE (US)

( * ) Notice: Subject to any disclaimer, the term of this patent is extended or adjusted under 35 U.S.C. 154(b) by 0 days.

(21) Appl. No.: 15/440,040

(22) Filed: Feb. 23, 2017

(65) Prior Publication Data

US 2018/0240576 A1 Aug. 23, 2018

(51) Int. Cl.

| | |
|---|---|
| ***H01C 1/148*** | (2006.01) |
| ***H01C 17/00*** | (2006.01) |
| ***H01C 17/28*** | (2006.01) |
| ***H01C 1/012*** | (2006.01) |

(52) U.S. Cl.

CPC ..... *H01C 17/006* (2013.01); *H01C 1/012* (2013.01); *H01C 1/148* (2013.01); *H01C 17/28* (2013.01)

(58) Field of Classification Search

CPC ..... H01C 17/006; H01C 17/28; H01C 1/012; H01C 1/148

USPC ..... 338/332

See application file for complete search history.

(56) References Cited

U.S. PATENT DOCUMENTS

| | | | | |
|---|---|---|---|---|
| 3,583,931 | A | 6/1971 | Bouchard | |
| 5,518,663 | A | 5/1996 | Labranche et al. | |
| 7,280,028 | B2 * | 10/2007 | Nelson | G01K 7/18 338/22 R |
| 7,485,245 | B1 * | 2/2009 | Konno | C03C 8/18 136/243 |
| 8,815,125 | B2 | 8/2014 | Ogata | |
| 9,761,348 | B2 * | 9/2017 | Kim | H01B 1/22 |
| 2006/0052229 | A1 * | 3/2006 | Tanaka | C03C 8/22 501/16 |
| 2009/0261307 | A1 | 10/2009 | Hayakawa et al. | |
| 2011/0089381 | A1 | 4/2011 | Labranche et al. | |
| 2011/0308597 | A1 * | 12/2011 | Carroll | B22F 1/0059 136/256 |
| 2012/0164314 | A1 | 6/2012 | LaBranche et al. | |
| 2015/0255185 | A1 * | 9/2015 | Kim | C03C 8/12 252/519.21 |

FOREIGN PATENT DOCUMENTS

| | | | |
|---|---|---|---|
| JP | 5426241 | B2 | 2/2014 |

OTHER PUBLICATIONS

Nishizawa et al., JP 04-293214, Oct. 1992. Machine translation.*

* cited by examiner

*Primary Examiner* — Kyung Lee

(57) ABSTRACT

The invention relates to a chip resistor. A method of manufacturing a chip resistor comprises the steps of: (a) applying a conductive paste on an insulating substrate, wherein the conductive paste comprises, (i) 40 to 80 weight percent (wt. %) of a conductive powder; (ii) 1 to 14 wt. % of a glass frit, (iii) 0.01 to 3 wt. % of magnesium oxide (MgO), and (iv) 10 to 55 wt. % of an organic vehicle, wherein the wt. % is based on weight of the conductive paste; (b) firing the applied conductive paste to form the front electrodes.

13 Claims, 1 Drawing Sheet

CHIP RESISTOR

FIELD OF INVENTION

The present invention relates to a chip resistor, particularly to a conductive paste to form a chip resistor front electrode.

TECHNICAL BACKGROUND OF THE INVENTION

A front electrode of a chip resistor needs resistance against acid derived from solder or plating used in the manufacturing process.

JP5426241 discloses a chip resistor. The front electrode of the chip resistor was formed by printing a conductive paste containing a metal powder, a Pb-free glass frit and a resin binder, wherein the metal powder is selected from a group consisting of gold (Au), silver (Ag), platinum (Pt), palladium (Pd) and alloy of those, and the glass frit contains a first glass frit containing 60 wt. % or more of $SiO_2$ and a second glass frit containing 5 wt. % or more of $TiO_2$, the weight ratio of the first glass frit and the second glass frit is 1:3 to 5:1.

SUMMARY OF THE INVENTION

An objective is to provide a method of manufacturing a chip resistor having acid resistance.

An aspect relates to a method of manufacturing a chip resistor comprising the steps of: (a) applying a conductive paste on an insulating substrate, wherein the conductive paste comprises, (i) 40 to 80 weight percent (wt. %) of a conductive powder; (ii) 1 to 14 wt. % of a glass frit, (iii) 0.01 to 3 wt. % of magnesium oxide (MgO), and (iv) 10 to 55 wt. % of an organic vehicle, wherein the wt. % is based on the weight of the conductive paste; (b) firing the applied conductive paste to form the front electrodes.

Another aspect relates to a conductive paste to form front electrodes of a chip resistor, the conductive paste comprising: (i) 40 to 80 weight percent (wt. %) of a conductive powder; (ii) 1 to 14 wt. % of a glass frit, (iii) 0.01 to 3 wt. % of magnesium oxide (MgO), and (iv) 10 to 55 wt. % of an organic vehicle, wherein the wt. % is based on the weight of the conductive paste.

Another aspect relates to a chip resistor comprises an insulating substrate, a pair of front electrodes formed on the insulating substrate, and a resistor thick film formed on the insulating substrate to bridge the pair of front electrodes, wherein the front electrodes comprises a conductive metal, a glass and magnesium oxide (MgO).

A chip resistor having acid resistance can be provided by the present invention.

DESCRIPTION OF THE PREFERRED EMBODIMENTS

The method of forming a chip resistor is explained with FIGS. 1 to 4.

Figure 1:
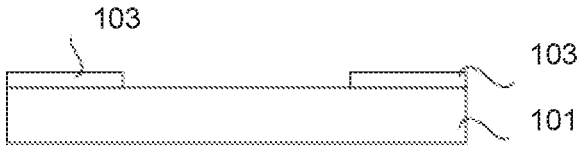
FIGS. 1 to 4 are schematic diagrams for illustrating the method of manufacturing a chip resistor.

An insulating substrate 101 is prepared (FIG. 1). The insulating substrate 101 is a ceramic substrate in an embodiment, an alumina substrate in another embodiment.

A conductive paste 103 is applied on the front side of the substrate 101. The conductive paste 103 is screen printed on the insulating substrate 101 in an embodiment. The conductive paste is applied in a square pattern at both edges of the substrate 101 in an embodiment. The square pattern of the applied conductive paste is 50 to 500 μm wide, 150 to 600 μm long and 1 to 20 μm thick in an embodiment. The conductive paste viscosity can be adjusted to be suitable for an applying method such as screen printing. Viscosity of the conductive paste is 100 to 450 Pa·s in an embodiment, 200 to 380 Pa·s in another embodiment, measured by Brookfield HBT with a spindle #14 at 10 rpm.

The conductive paste layers 103 are fired to form front electrodes. The firing peak temperature is 700 to 950° C. in an embodiment, 750 to 920° C. in another embodiment, 800 to 900° C. in another embodiment. Firing time at the peak temperature is 3 to 30 minutes in an embodiment, 5 to 20 minutes in another embodiment, 7 to 15 minutes in another embodiment.

Figure 2:
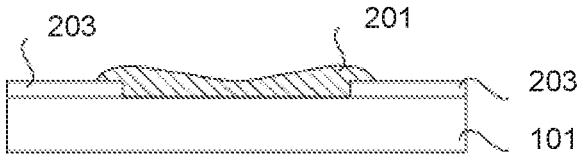

A resistor paste 201 is applied on the insulating substrate 101 to bridge the front electrodes 203 (FIG. 2). The both edges of the resistor paste layer 201 superpose on inner end of the front electrodes 203 in an embodiment.

Figure 3:
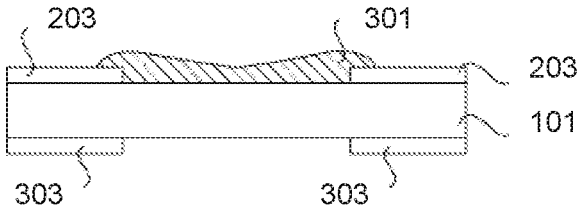

The resistor paste layer 201 is fired to form a resistor thick film 301 (FIG. 3). The firing temperature is 700 to 950° C. in an embodiment, 750 to 920° C. in another embodiment, 800 to 900° C. in another embodiment. Firing time at the firing temperature is 3 to 30 minutes in an embodiment, 5 to 20 minutes in another embodiment, 7 to 15 minutes in another embodiment. US2012164314, US2009261307, US2011089381 can be herein incorporated by reference for the resistor thick film.

Resistivity can be adjusted by forming trimming grooves on the resistor thick film 301 in an embodiment. The trimming grooves are formed by laser on the resistor thick film 201 in an embodiment. The trimming grooves is single line, double lines or L-shape line in an embodiment. The laser is Yttrium-Aluminum-Garnet (YAG) laser (1064 nm), Greeb laser (532 nm) or UV laser (360 nm) in an embodiment. A laser trimmer, for example, LSR436 series from OMRON LASERFRONT INC. is available.

A pair of back side electrodes 303 can be optionally formed on the back side of the substrate 101 in an embodiment. The back side is the opposite side of the front side where the front electrodes 203 are formed. The back side electrodes 303 can be formed by applying a conductive paste and firing the applied conductive paste. The conductive paste to form the front electrodes 203 can be used to form the back side electrodes 303 as well in an embodiment. The conductive paste to form the back side electrodes 303 can be different from the front electrodes 203 in another embodiment. The applying method and the firing condition can be same as the front electrodes 203 in an embodiment.

Figure 4:
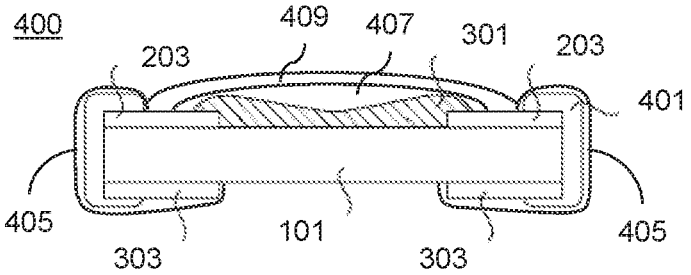

The chip resistor 400 can further comprise outer electrodes 401 on both sides of the chip resistor in an embodiment (FIG. 4). The outer electrodes 401 can be formed by dipping the sides of the chip resistor into a conductive slurry in an embodiment. The conductive slurry comprises at least a metal powder and an organic medium in another embodiment. The conductive slurry applied on both sides of the chip resister is heated. The heating temperature is 150 to 300° C. when the conductive slurry is heat-curable type in an embodiment. The heating temperature is 600 to 950° C. when the conductive slurry is firing type in another embodiment.

The chip resistor 400 can optionally comprise plating layers 405 on the outer electrodes 401 and the back side electrodes 303 in an embodiment. The plating layer 405 could enhance the solderability and solder leach resistance of the electrodes. The plating layer 405 can be a nickel layer, a tin layer or a combination thereof in another embodiment. The chip resistor 400 comprises no plating layers on the outer electrodes 401 in another embodiment.

The chip resistor 400 can optionally further comprise a glass coat 407 and a resin coat 409 over the resistor thick film 301 in an embodiment. The glass coat 407 and the resin coat 409 could prevent the front electrodes 203 and the resistor thick film 301 from being exposed to the air.

The chip resistor 400 is mounted in an electrical device by soldering in an embodiment.

The conductive paste to form the front electrodes is explained hereafter. The conductive paste comprises (i) 40 to 80 wt. % of a conductive powder; (ii) 1 to 14 wt. % of a glass frit, (iii) 0.01 to 3 wt. % of magnesium oxide (MgO), and (iv) 10 to 55 wt. % of an organic vehicle, based on the weight of the conductive paste.

(i) Conductive Powder

A conductive powder is a powder to provide the front electrode with electrically conductivity. A conductive powder is a metal powder with an electrical conductivity $7.00\times10^6$ Siemens (S)/m or higher at 293 Kelvin in an embodiment, $8.50\times10^6$ S/m or higher at 293 Kelvin in another embodiment, $1.00\times10^7$ S/m or higher at 293 Kelvin in another embodiment, $4.00\times10^7$ S/m or higher at 293 Kelvin in another embodiment.

The conductive powder can be a metal powder selected from the group consisting of aluminum (Al, $3.64\times10^7$ S/m), nickel (Ni, $1.45\times10^7$ S/m), copper (Cu, $5.81\times10^7$ S/m), silver (Ag, $6.17\times10^7$ S/m), gold (Au, $4.17\times10^7$ S/m), molybdenum (Mo, $2.10\times10^7$ S/m), magnesium (Mg, $2.30\times10^7$ S/m), tungsten (W, $1.82\times10^7$ S/m), cobalt (Co, $1.46\times10^7$ S/m), zinc (Zn, $1.64\times10^7$ S/m), platinum (Pt, $9.43\times10^6$ S/m), palladium (Pd, $9.5\times10^6$ S/m), an alloy thereof and a mixture thereof in an embodiment. The conductive powder can be selected from the group consisting of silver, gold, copper, an alloy thereof and a mixture thereof in another embodiment. The conductive powder can be silver in another embodiment.

Particle diameter (D50) of the conductive powder is 0.5 to 12 μm in an embodiment, 1 to 10.5 μm in another embodiment, and 1.3 to 9.5 μm in another embodiment. The particle diameter (D50) can be measured by laser diffraction scattering method with Microtrac model S-3500.

Specific surface area (SA) of the conductive powder is 1.5 to 8 $m^2/g$ in an embodiment, 1.9 to 6.9 $m^2/g$ in another embodiment and 2.2 to 5.5 $m^2/g$ in another embodiment. The specific surface area can be measured by BET method with Monosorb™ from Quantachrome Instruments Corporation.

The conductive powder is 40 to 80 weight percent (wt. %), 52 to 75 wt. % in another embodiment, 54 to 70 wt. % in another embodiment, 55 to 65 wt. % in another embodiment based on the weight of the conductive paste.

(ii) Glass Frit

The glass frit functions to increase adhesion of the front electrodes to the substrate.

The chemical composition of the glass frit is not limited. The glass frit comprises a metal oxide selected from the group consisting of bismuth oxide ($Bi_2O_3$), boron oxide ($B_2O_3$), zinc oxide (ZnO), aluminum oxide ($Al_2O_3$), silicon oxide ($SiO_2$) and a mixture thereof in an embodiment. The glass frit is a Si—B—Zn glass, a Bi—B—Zn glass or a mixture thereof in another embodiment. The glass frit comprises no lead in another embodiment.

The softening point of the glass frit is 350 to 750° C. in an embodiment, 400 to 700° C. in another embodiment, 500 to 700° C. in another embodiment. The glass frit is 1 to 14 wt. %, 3 to 12 wt. % in another embodiment, 5 to 9 wt. % in an embodiment based on the weight of the conductive paste.

(iii) Magnesium Oxide

Magnesium oxide (MgO) could improve acid resistance of the front electrode as shown in Example below. The MgO is in shape of powder in an embodiment. The particle diameter ($D_{50}$) of the MgO powder is 0.1 to 8 μm in an embodiment, 0.2 to 6.5 μm in another embodiment, 0.4 to 5.5 μm in another embodiment, 0.8 to 5 μm in another embodiment. The particle diameter (D50) can be measured by laser diffraction scattering method with Microtrac model S-3500.

The MgO is 0.01 to 3 wt. %, 0.05 to 2.1 wt. % in another embodiment, 0.1 to 1.5 wt. % in another embodiment, 0.2 to 1.3 wt. % in another embodiment, 0.3 to 0.8 wt. % in another embodiment, based on the weight of the conductive paste.

The conductive paste comprises the glass frit and the MgO powder separately in an embodiment.

(iv) Organic Vehicle

The conductive powder and the glass frit are dispersed in an organic vehicle to form a "paste" having suitable viscosity for applying on a substrate.

The organic vehicle comprises an organic polymer and optionally a solvent in an embodiment. A wide variety of inert viscous materials can be used as an organic polymer. The organic polymer can be selected from the group consisting of ethyl cellulose, ethylhydroxyethyl cellulose, wood rosin, phenolic resin, polymethacrylate of lower alcohol, monobutyl ether of ethylene glycol monoacetate and a mixture thereof.

The organic vehicle optionally comprises a solvent for the purpose of adjusting the viscosity in an embodiment. The solvent can be selected from the group consisting of texanol, ester alcohol, terpineol, kerosene, dibutylphthalate, butyl carbitol, butyl carbitol acetate, hexylene glycol, dibasic ester and a mixture thereof. The solvent is chosen in view of the organic polymer solubility. In an embodiment, the organic medium can be a mixture of ethyl cellulose and texanol.

The organic vehicle optionally comprises an organic additive. The organic additive comprises one or more of a thickener, stabilizer, viscosity modifier, surfactant and thixotropic agent in an embodiment. The amount of the organic additive depends on the desired characteristics of the resulting electrically conductive paste.

The organic vehicle is 10 to 55 wt. %, 15 to 48 wt. % in another embodiment, and 20 to 35 wt. % in another embodiment based on the weight of the conductive paste.

(v) Anorthite

The conductive paste can further comprise anorthite ($CaAl_2Si_2O_8$) in an embodiment. Anorthite could increase adhesion of the front electrodes to an insulating substrate.

The anorthite is in shape of powder in an embodiment. The particle diameter ($D_{50}$) of the anorthite is 0.5 to 5 μm in an embodiment, 0.7 to 3 μm in another embodiment, 0.8 to 2 μm in another embodiment. The particle diameter (D50) can be measured by laser diffraction scattering method with Microtrac model S-3500.

The anorthite is 0.01 to 3 wt. % in an embodiment, 0.05 to 1.5 wt. % in another embodiment, 0.1 to 1.0 wt. % in another embodiment, based on the weight of the conductive paste.

For anorthite, U.S. Pat. No. 5,518,663 can be herein incorporated by reference.

(vi) Additional Metal Oxide

The conductive paste could further comprise an additional metal oxide in an embodiment. The additional metal oxide could function as a TCR adjuster or a solder leach resistance improver. The additional metal oxide can be selected from the group consisting of ZnO, iridium oxide ($Ir_2O_3$, $IrO_2$), titanium oxide ($TiO_2$), rhodium oxide ($Rh_2O_3$, $RhO_2$, $RhO_3$), ruthenium oxide ($RuO_2$, $RuO_3$, $RuO_4$), rhenium oxide ($Re_2O_3$, $ReO_3$, $Re_2O_7$), tin oxide (SnO, $SnO_2$), a ruthenium pyrochlore oxide and a mixture thereof in another embodiment.

The ruthenium pyrochlore oxide can be bismuth ruthenate ($Bi_2Ru_2O_7$), copprt bismuth ruthenate ($CuBiRu_2O_{6.5}$) or a mixture thereof in another embodiment. For the ruthenium pyrochlore oxide, U.S. Pat. No. 3,583,931 and U.S. Pat. No. 8,815,125 can be herein incorporated by reference.

The particle diameter ($D_{50}$) of the additional metal oxide is 0.1 to 10 μm in an embodiment, 0.5 to 5 μm in another embodiment.

The additional metal oxide is 0.5 to 5.0 wt % in an embodiment, 1.0 to 4.0 wt % in another embodiment, 1.8 to 3.2 wt % in another embodiment based on the weight of the conductive paste.

EXAMPLES

The present invention is illustrated by, but is not limited to, the following examples.

The silver powder, the Si—B—Zn glass frit and metal oxides were dispersed in an organic vehicle in a mixer and homogenized by a three-roll mill. The silver powder was a mixture of a first Ag powder (particle diameter (D50): about 2 μm, SA: about 3 $m^2/g$) and a second Ag powder (particle diameter (D50): about 9 μm, SA: about 4 $m^2/g$). The amount of each material is shown in Table 1. The organic vehicle was a mixture of 35 wt. % of a resin, 54 wt. % of a solvent and 11 wt. % of organic additives based on the weight of the organic vehicle. The paste viscosity was about 340 Pa·s measured by Brookfield HBT with a spindle #14 at 10 rpm.

Figure 5:
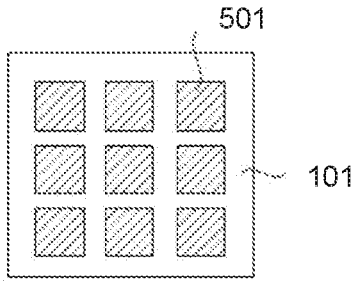
FIG. 5 is a diagram showing an electrode pattern in the Examples.

The conductive paste was screen printed on an alumina substrate 101 (25 mm long, 25 mm wide, 0.6 mm thick) in a square pattern 501 (FIG. 5). The pattern 501 was nine squares and each size was 2 mm wide, 2 mm long and 8 μm thick. The front electrode was formed by firing the square patterns 501 at 850° C. for 10 minutes after drying at 150° C. for 10 minutes.

The acid resistance of the square patterns was measured. The alumina substrate 101 with the square patterns 501 was dipped into a sulfonic acid tin plating solution of pH 1 for one hour. The alumina substrate 101 was taken out and dried. All of the nine squares of the front electrodes were taped with a Scotch® tape and then peeled off by hand. The number of peeled-off electrodes out of nine was counted.

The resistivity (Rs) of the front electrode was measured to see if the front electrode containing the metal oxide could have sufficiently low resistivity. The front electrode of a line pattern was newly formed on the alumina substrate. The line pattern electrode was 0.5 mm wide, 135.5 mm long and 8 μm thick. The resistivity of the line pattern electrode was measured with a digital multimeter (Model 2100, Keithley Instruments, Inc.).

The results were shown in Table 1. The number of the peeled-off electrodes drastically lowered when the conductive paste comprised the MgO powder in Examples (Ex.) 1 to 3, compared to Comparative Examples (Com. Ex.) 1 to 8 where the conductive paste comprised no metal oxide, CuO, $Bi_2O_3$, ZnO, $Fe_2O_3$, ZrO, $MnO_2$, and CaO respectively. The resistivity of the front electrode containing the metal oxide could all stay in 8.0 mohm/sq. or lower which was acceptably low (Comparative Examples 1 to 8 and Examples 1 to 3).

TABLE 1

(wt. %)

| | Com. Ex. 1 | Com. Ex. 2 | Com. Ex. 3 | Com. Ex. 4 | Com. Ex. 5 | Com. Ex. 6 | Com. Ex. 7 | Com. Ex. 8 | Ex. 1 | Ex. 2 | Ex. 3 |
|---|---|---|---|---|---|---|---|---|---|---|---|
| Ag powder | 60 | 60 | 60 | 60 | 60 | 60 | 60 | 60 | 60 | 60 | 60 |
| Glass frit | 7.5 | 7.5 | 7.5 | 7.5 | 7.5 | 7.5 | 7.5 | 7.5 | 7.5 | 7.5 | 7.5 |
| Organic vehicle | 29.5 | 29.0 | 29.0 | 29.0 | 29.0 | 29.0 | 29.0 | 29.0 | 29.0 | 28.5 | 28.0 |
| Metal oxide | | | | | | | | | | | |
| CuO | 0 | 0.5 | 0 | 0 | 0 | 0 | 0 | 0 | 0 | 0 | 0 |
| $Bi_2O_3$ | 0 | 0 | 0.5 | 0 | 0 | 0 | 0 | 0 | 0 | 0 | 0 |
| ZnO | 0 | 0 | 0 | 0.5 | 0 | 0 | 0 | 0 | 0 | 0 | 0 |
| $Fe_2O_3$ | 0 | 0 | 0 | 0 | 0.5 | 0 | 0 | 0 | 0 | 0 | 0 |
| ZrO | 0 | 0 | 0 | 0 | 0 | 0.5 | 0 | 0 | 0 | 0 | 0 |
| $MnO_2$ | 0 | 0 | 0 | 0 | 0 | 0 | 0.5 | 0 | 0 | 0 | 0 |
| CaO | 0 | 0 | 0 | 0 | 0 | 0 | 0 | 0.5 | 0 | 0 | 0 |
| MgO | 0 | 0 | 0 | 0 | 0 | 0 | 0 | 0 | 0.5 | 1.0 | 1.5 |
| Additional metal oxide | 3.0 | 3.0 | 3.0 | 3.0 | 3.0 | 3.0 | 3.0 | 3.0 | 3.0 | 3.0 | 3.0 |
| Acid resistance | 9/9 | 9/9 | 9/9 | 9/9 | 9/9 | 9/9 | 9/9 | 9/9 | 1/9 | 0/9 | 0/9 |
| Rs (mohm/sq.) | 5.8 | 5.8 | 5.7 | 6.0 | 5.5 | 6.4 | 6.1 | 8.0 | 5.9 | 6.5 | 7.4 |

The acid resistance and the resistivity were measured when the conductive paste further contained anorthite ($CaAl_2Si_2O_8$, D50: 1.1 μm) as an adhesion enhancer.

The front electrode was formed and measured its acid resistance and resistivity in the same manner as Example 1 except for using different conductive paste as shown in Table 2. Both the acid resistance and resistivity of the front electrode were sufficient in all Examples 4 to 6.

TABLE 2

| | (wt. %) | | |
|---|---|---|---|
| | Example 4 | Example 5 | Example 6 |
| Ag powder | 60 | 60 | 60 |
| Glass frit | 7.5 | 7.5 | 7.5 |
| Organic vehicle | 28.5 | 28.0 | 27.5 |
| MgO | 0.5 | 1.0 | 1.5 |
| Anorthite | 0.5 | 0.5 | 0.5 |
| Additional metal oxide | 3.0 | 3.0 | 3.0 |
| Acid resistance | 0/9 | 0/9 | 0/9 |
| Rs (mohm/sq.) | 5.6 | 6.4 | 7.2 |

Effects of the particle diameter of the MgO powder was examined. The front electrode was formed and measured its acid resistance and resistivity in the same manner as Example 1 except for using different conductive paste as shown in Table 3. The particle diameter (D50) of the MgO powder was 0.5 μm, 1.0 μm and 4.7 μm respectively. Both acid resistance and resistivity of the front electrode were sufficient regardless of the MgO powder particle diameter in all Examples 7 to 9.

TABLE 3

| | (wt. %) | | |
|---|---|---|---|
| | Example 7 | Example 8 | Example 9 |
| Ag powder | 62 | 62 | 62 |
| Glass frit | 7.0 | 7.0 | 7.0 |
| Organic vehicle | 26.8 | 26.8 | 26.8 |
| MgO | 0.7 | 0.7 | 0.7 |
| (D50) | (0.5 μm) | (1.0 μm) | (4.7 μm) |
| Anorthite | 0.5 | 0.5 | 0.5 |
| Additional metal oxide | 3.0 | 3.0 | 3.0 |
| Acid resistance | 0/9 | 0/9 | 0/9 |
| Rs (mohm/sq.) | 6.5 | 4.5 | 4.5 |

What is claimed is:

1. A method of manufacturing a chip resistor comprising the steps of:

(a) applying a conductive paste on an insulating substrate, wherein the conductive paste comprises, (i) 40 to 80 weight percent (wt. %) of a conductive powder;

(ii) 1 to 14 wt. % of a glass frit, (iii) 0.01 to 3 wt. % of magnesium oxide (MgO), (iv) 10 to 55 wt. % of an organic vehicle, and (v) anorthite ($CaAl_2Si_2O_8$), wherein the wt. % is based on weight of the conductive paste;

(b) firing the applied conductive paste to form the front electrodes.

2. The method of claim 1, wherein the insulating substrate is a ceramic substrate.

3. The method of claim 1, wherein particle diameter (D50) of the conductive powder is 0.5 to 12 μm.

4. The method of claim 1, wherein the conductive powder is selected from the group consisting of aluminum, nickel, copper, silver, gold, molybdenum, magnesium, tungsten, cobalt, zinc, platinum, palladium, an alloy thereof and a mixture thereof.

5. The method of claim 1, wherein the glass frit is a lead-free glass frit comprising a metal oxide selected from the group consisting of bismuth oxide ($Bi_2O_3$), boron oxide ($B_2O_3$), zinc oxide (ZnO), aluminum oxide ($Al_2O_3$), silicon oxide ($SiO_2$) and a mixture thereof.

6. The method of claim 1, wherein the MgO is in shape of powder with particle diameter (D50) of 0.1 to 8 μm.

7. The method of claim 1, wherein the firing temperature in step (b) is 700 to 950° C.

8. The method of claim 1, wherein the method further comprises steps (c) applying a resistor paste on the insulating substrate to bridge a pair of front electrodes; and (d) firing the applied resistor paste to form a resistor thick film.

9. A conductive paste to form front electrodes of a chip resistor, the conductive paste comprises:

(i) 40 to 80 weight percent (wt. %) of a conductive powder;

(ii) 1 to 14 wt. % of a glass frit, (iii) 0.01 to 3 wt. % of magnesium oxide (MgO), (iv) 10 to 55 wt. % of an organic vehicle, and (v) anorthite ($CaAl_2Si_2O_8$), wherein the wt. % is based on weight of the conductive paste.

10. The conductive paste of claim 9, wherein particle diameter (D50) of the conductive powder is 0.5 to 12 μm.

11. The conductive paste of claim 9, wherein the glass frit is a lead-free glass frit comprising a metal oxide selected from the group consisting of bismuth oxide ($Bi_2O_3$), boron oxide ($B_2O_3$), zinc oxide (ZnO), aluminum oxide ($Al_2O_3$), silicon oxide ($SiO_2$) and a mixture thereof.

12. The conductive paste of claim 9, wherein the MgO is in shape of powder with particle diameter (D50) of 0.1 to 8 μm.

13. A chip resistor comprises an insulating substrate, a pair of front electrodes formed on the insulating substrate, and a resistor thick film formed on the insulating substrate to bridge a pair of front electrodes, wherein the front electrodes comprises a conductive metal, a glass, and magnesium oxide (MgO) and anorthite ($CaAl_2Si_2O_8$).

* * * * *